US006736072B2

(12) United States Patent
Degelman et al.

(10) Patent No.: US 6,736,072 B2
(45) Date of Patent: May 18, 2004

(54) SLIDING RAILCAR DOOR

(75) Inventors: Paul Degelman, Regina (CA); Justin Tremblay, Regina (CA)

(73) Assignee: Degelman Industries Ltd., Regina (CA)

( * ) Notice: Subject to any disclaimer, the term of this patent is extended or adjusted under 35 U.S.C. 154(b) by 0 days.

(21) Appl. No.: 10/198,655

(22) Filed: May 16, 2002

(65) Prior Publication Data

US 2002/0195020 A1 Dec. 26, 2002

Related U.S. Application Data

(60) Provisional application No. 60/291,012, filed on May 16, 2001, and provisional application No. 60/304,081, filed on Jul. 11, 2001.

(51) Int. Cl.[7] ..... B61D 3/00

(52) U.S. Cl. ..... 105/258; 105/280; 296/155

(58) Field of Search ..... 105/406.2, 258, 105/280, 333, 341, 282.1, 282.2, 332; 49/501; 160/135, 231.2, 352; 296/155

(56) References Cited

U.S. PATENT DOCUMENTS 3,635,278 A * 1/1972 Bocade ..... 160/206
4,116,135 A * 9/1978 Jaekle et al. ..... 410/26
4,368,772 A * 1/1983 Bouthillier ..... 160/232
5,148,850 A * 9/1992 Urbanick ..... 160/231.1
5,176,388 A * 1/1993 Horton ..... 296/155
5,282,663 A * 2/1994 Horton ..... 296/155
5,467,558 A * 11/1995 Kober et al. ..... 49/220
5,613,541 A * 3/1997 Bradbury ..... 160/231.2
6,296,038 B1 * 10/2001 Chen ..... 160/199

FOREIGN PATENT DOCUMENTS

EP 159206 A1 * 10/1985 ..... B60J/5/06

* cited by examiner

*Primary Examiner*—Frantz F. Jules
(74) *Attorney, Agent, or Firm*—Ryan W. Dupuis; Adrian D. Battison; Michael R. Williams

(57) ABSTRACT

A sliding door is provided for a rail car of the type having a floor, a side wall along one side of the floor and standing upwardly from the floor and an opening in the side wall. The sliding door is mounted on top and bottom rails at the opening extending parallel to a plane of the opening with the door movable from a closed position at the opening to an open position spaced along the rails from the opening. The sliding door is formed of modular panel sections which are replaceable independently of one another when damaged. The sliding door includes a flexible portion being movable between a relaxed position and a flexed position in which the flexible portion is deflected in a direction transversely to the plane of the opening in relation to the relaxed position in order to minimize damage to the, door when impacted.

18 Claims, 4 Drawing Sheets

SLIDING RAILCAR DOOR

This application claims benefit of Provisional Application 60/291,012 filed May 16, 2001 and claims benefit of Provisional Application 60/304,081 filed Jul. 11, 2001.

FIELD OF THE INVENTION

A sliding door is provided for a railcar which is formed in modular sections and more particular which includes a flexible portion permitting the modular sections to be deflected relative to one another.

BACKGROUND

Box rail cars of the type having sliding doors are commonly loaded using various lifting and handling equipment. Known sliding doors for these types of rail cars generally are not suitably arranged to absorb impacts which are known to occur from the lifting and handling equipment used for loading the boxcars. As a result damage to sliding doors is one of the most common repairs required in the maintenance of box rail cars. Among the repairs to doors of this type, straightening the doors as a result of impacts from lifting and handling equipment is the most common.

SUMMARY

According to one aspect of the present invention there is provided a sliding door for a rail car construction comprising a floor, a side wall along one side of the floor and standing upwardly from the floor and an opening in the side wall, the sliding door comprising:

a sliding door member arranged to be mounted on top and bottom rails at the opening extending parallel to a plane of the opening with the door movable from a closed position at the opening to an open position spaced along the rails from the opening;

the sliding door member including a flexible portion being movable between a relaxed position and a flexed position in which the flexible portion is deflected in a direction transversely to the plane of the opening in relation to the relaxed position.

Providing a sliding door for a rail car having a flexible portion permits the door to absorb the impacts known to occur when loading a rail car, thus preventing permanent deformation of the door which would otherwise require costly repair when no flexible portion is provided. Having only a portion of the door being flexible permits the door to remain sufficiently structurally rigid to contain cargo within the rail car as required.

The door member is preferably divided into at least two panel sections and includes a flexible coupling connecting said at least two panel sections together so as to permit deflection of the sliding door member at an intersection of said at least two panel sections in a direction transversely to the plane of the opening.

The door member may include at least one lateral intersection extending between respective sides of the door member and dividing the door into panel sections being connected one above the other by the flexible coupling or at least one longitudinal intersection extending between respective top and bottom ends of the door member and dividing the door into panel sections being connected laterally adjacent one another by the flexible coupling.

The intersection between said at least two panel sections preferably comprises an end plate on each panel section adjacent the intersection and a resilient material mounted between the end plates. The panel sections may be connected by the flexible coupling using threaded fasteners such that the panel sections are selectively separable from one another.

There may be provided a plurality of panel sections, each coupled to adjacent panel sections by a flexible coupling, preferably at least two panel sections being substantially identical to one another.

Edges of the panel sections preferably each comprise a mounting flange oriented perpendicularly to a plane of the respective panel section having a plurality of mounting apertures therein, the mounting apertures being arranged for alignment with the mounting apertures of an adjacent panel section when the panel sections are abutted one adjacent the other for receiving respective fasteners therethrough.

There may be provided a peripheral guard supported on each side of the door member, the peripheral guard spanning plural panel sections along respective sides of the door member.

When the door is divided horizontally into a plurality of panel sections, each peripheral guard preferably comprises a rigid member spanning substantially a full length of the respective side of the door member.

According to a second aspect of the present invention there is provided a sliding door for a rail car construction comprising a floor, a side wall along one side of the floor and standing upwardly from the floor and an opening in the side wall, the sliding door comprising:

a door member arranged to be supported on top and bottom rails at the opening extending parallel to a plane of the opening, movable from a closed position at the opening to an open position spaced along the rails from the opening;

the door member comprising a plurality of panel sections, each panel section having top, bottom and side edges selectively mounted to corresponding edges of respective adjacent panel sections each having a similar configuration; and top and bottom rail guides arranged to be selectively mounted on the respective top and bottom ends of the sliding door member, the top and bottom rail guides being arranged to support the door member on the respective top and bottom rails.

Providing a sliding door for a rail car formed of modular sections permits the door to accommodate the impacts known to occur when loading a rail car by permitting individual damaged sections to be replaced-independently of one another. The resulting repair costs for impacted and damaged doors are dramatically reduced by replacing individual sections of the door instead of the entire door. By forming the sections of the door identical to one another, costs can further be reduced as only a single modular section design is required to be manufactured and supplied to customers.

The panel sections may all be identical to one another. In one arrangement, only the top edges of the respective panel sections may be all substantially identical to one another, or alternatively, the bottom edges of the respective panel sections may be all substantially identical to one another. In yet a further arrangement, side edges of the panel sections are all substantially identical to one another. It is preferred for simplicity however, that all edges of the panel sections be similar in configuration to one another.

The top rail guides are preferably supported on the top edges of respective panel sections at the top end of the door member by threaded fasteners for ease of replacement if required. Similarly, the bottom rail guides are preferably supported on the bottom edges of respective panel sections at the bottom end of the door member by threaded fasteners When there is provided a base section selectively mounted on the bottom edge of each panel section adjacent the bottom end of the door member, the bottom rail guides are preferably supported on the base sections by threaded fasteners.

There may be provided a plurality of side panel sections mounted along respective sides of the door member and a plurality of intermediate panel sections mounted between the respective side panel sections, the side panel sections all being identical to one another.

There may be provided a peripheral guard supported on each side of the door member, the peripheral guard also being arranged to be supported on the respective side edges of the panel sections along the respective sides of the door member using threaded fasteners.

BRIEF DESCRIPTION OF THE DRAWINGS

In the accompanying drawings, which illustrate an exemplary embodiment of the present invention.

DETAILED DESCRIPTION

Figure 1:
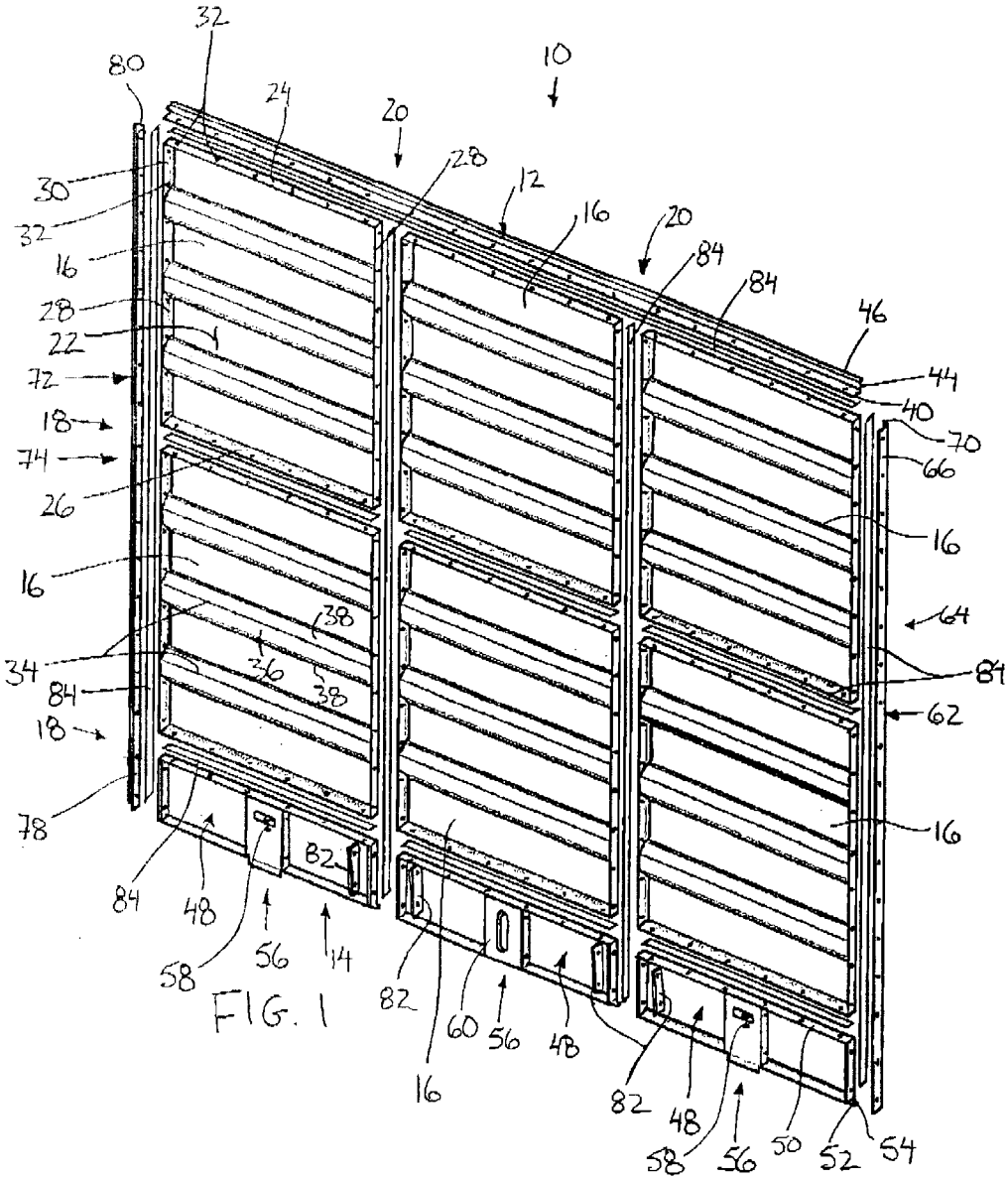
FIG. 1 is an exploded isometric view of the railcar door.
Figure 2:
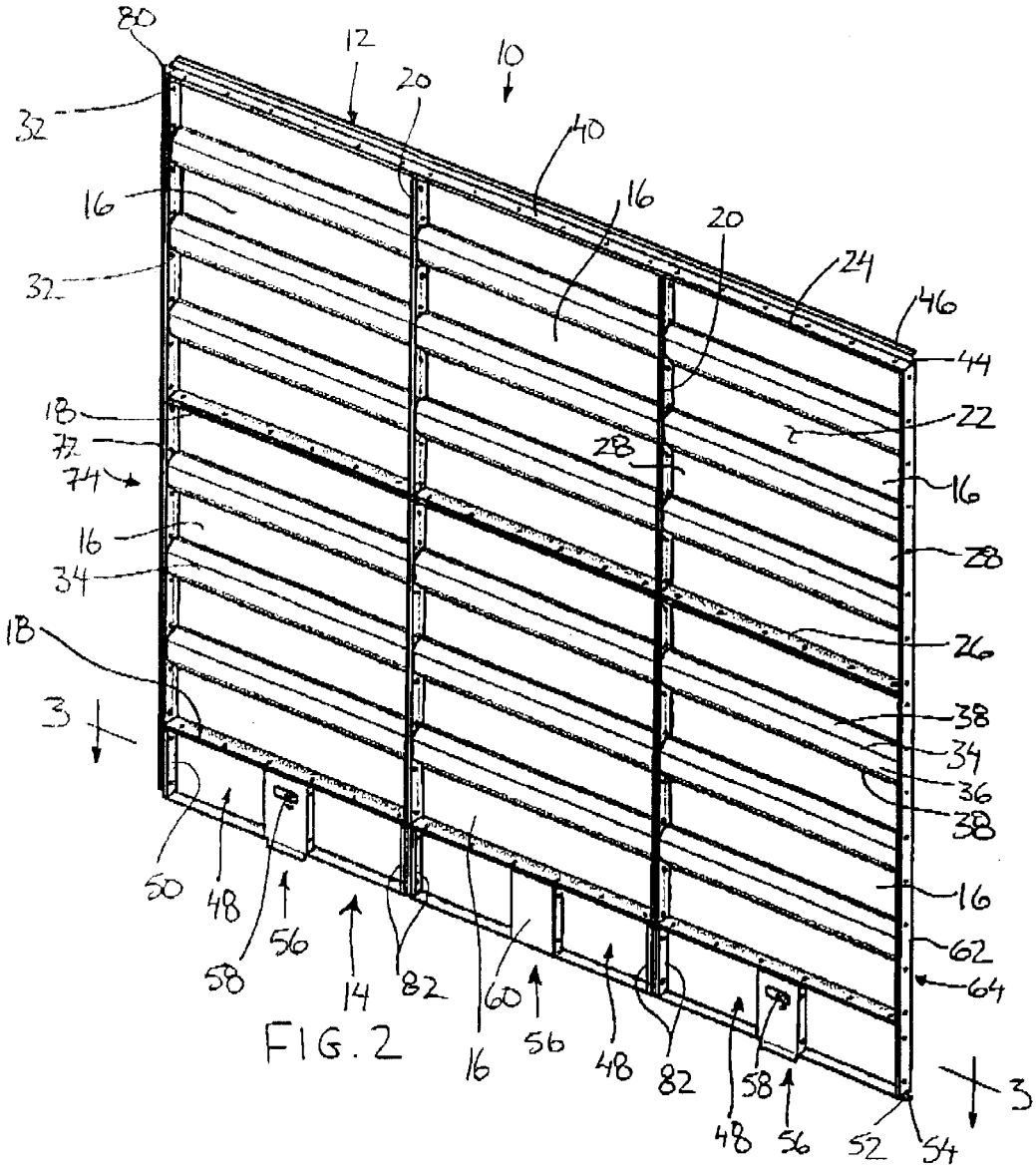
FIG. 2 is an assembled isometric view of the railcar door.
Figure 3:
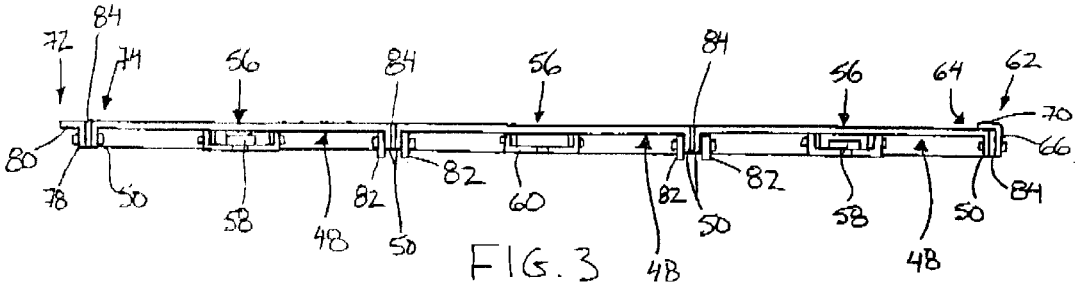
FIG. 3 is a sectional view along the line 3—3 of FIG. 2.

Referring to the accompanying drawings, there is illustrated a modular sliding door generally indicated by reference numeral 10. The door 10 is intended for use on a box type rail car 2 having a floor 4 with walls 6 extending upwardly from each side of the floor and an opening 8 in one of the walls along one side of the floor. The door 10 is suitably arranged for permitting individual sections of the door to be replaced instead of replacing the entire door as would normally be required when the door was impacted from a loader. The door 10 is further arranged for resisting considerable denting by allowing the door to be somewhat flexible.

The door is arranged to be mounted on the top and bottom rails at the opening in the rail car extending parallel to a plane of the opening. The door is supported on the top rail by top rail guides 12 and on the bottom rail by bottom rail guides 14. The rail guides 12, 14 support the door for sliding movement between a closed position at the opening and an open position spaced along the rails from the opening.

The door 10 comprises a door member which is formed of a plurality of modular panel sections 16. In the preferred embodiment as illustrated in the accompanying figures, six modular panel sections 16 are provided with two pairs of the sections comprising side panels mounted one above the other on each side of the door member with the remaining two sections 16 comprising intermediate panels mounted one above the other between the pairs of side panels. The door member is thus divided into one or more horizontal intersections 18 and a pair of spaced apart vertical intersections 20. All of the modular sections 16 as illustrated are identical to one another permitting any one modular section 16 to be interchanged with a replacement section having an identical configuration.

For use of the door 10 on different rail cars in which the opening in the rail car has a different width the intermediate panels may be replaced with panels having a similar configuration but which are different in width to accommodate either wider or narrower openings. The intermediate panels of varying width would be similar in configuration so as to similarly permit any one modular section 16 to be replaced independently of the others.

Each modular section 16 includes a back sheet 22 which spans the full width and height of the section 16 which is generally rectangular in shape. A top edge 24, a bottom edge 26 and both side edges 28 are all configured similarly to one another to permit each section to be bolted to a corresponding edge of an adjacent section.

Each edge of the modular sections 16 generally comprises a mounting flange 30 which lies perpendicularly to a plane of the panel section 16 within which the back sheet 22 lies. The mounting flange 30 extends the full depth of the modular section 16 from the back sheet 22 at the rear surface of the door member to a front side of the door member.

A plurality of mounting apertures 32 are located at spaced positions along each mounting flange 30 for receiving respective bolts therethrough. The mounting apertures 32, are arranged to be aligned with the apertures of adjacent modular sections 16 when the sections are abutted one against the other in a common plane one above the other or one beside the other in alignment together.

A plurality of structural support members 34 are mounted at vertically spaced positions across each modular section 16. Each structural support member 34 comprises a horizontal channel having a base member 36 which lies along front side of the door member parallel and spaced from the respective back sheet 22 and a pair of side members 38 which extend rearwardly at an outward incline from opposing sides of the base member 36 between the front and back sides of the corresponding modular section 16.

The modular sections 16 are thus arranged to be rigid in construction while being suitably adapted for mounting side by side or one above the other with other modular sections having the same configuration. Regardless of the order in which the modular sections 16 are assembled to form the door member as illustrated, a peripheral edge of the door member remains consistent for mounting the rail guides 12 and 14 thereon.

The top rail guide 12 includes a mounting flange 40 which is configured similarly to the mounting flanges on the top and bottom edges of each modular section 16 for securement along the top end of the door member. The mounting flange 40 is adapted to be selectively mounted to the mounting flanges 30 respective modular sections 16 using threaded fasteners such as bolts.

For supporting the top end of the door on the top rail of the box car, the top rail guide 12 includes a vertical flange 44 and a guide flange 46 mounted on the mounting flange 40 in an arrangement so as to have a generally T-shaped cross section. The vertical flange 44 extends vertically upward from a rearward edge of the mounting flange 40 of each rail guide section to an outer free end which mounts the guide flange 46 thereon perpendicularly thereto. The guide flange 46 is arranged to be received in a track of the top rail on the box car for guiding sliding movement of the rail car door between respective open and closed positions.

The bottom rail guide 14 is formed in bottom rail guide panel sections 48 which correspond to the modular panel sections 16 along the bottom end of the door member upon which the rail guide panel sections 48 are selectively mounted at the bottom edges 26 thereof. The panel sections 48 of the bottom rail guide 14 each comprise a panel having a width which corresponds to the width of a respective modular section 16 upon which the section 48 is bolted to using threaded fasteners while being much shorter in height than the modular sections 16, The edges of the bottom rail guide sections 48 similarly include a mounting flange 50 thereon extending perpendicularly to a rear surface of the door member and having apertures therein for receiving bolts so as to be similarly secured to the bottom edge of a respective modular section 16 while permitting the modular section 16 to be interchanged with a replacement section of identical configuration as required. Similarly to the modular sections 16, the bottom rail guide sections 48 include two outer sections and one intermediate section mounted between the two outer sections in a common plane therewith.

For guiding the door member along the bottom rail the bottom rail guide sections each include a vertical flange 52 extending downward from a rear side of the section and a guide flange 54 which projects rearwardly from a lower free end of the vertical flange 52 so as to be generally L-shaped in cross section with the vertical flange. The guide flange 54 is arranged to be received within a lower track of the bottom rail for guiding sliding movement of the door between the open and closed positions.

The bottom rail guide sections 48 are formed identical to one another so as to permit the sections 48 to be interchanged with one another. Each of the bottom rail guide sections 48 includes a center channel 56 therein which is oriented vertically across a center of the section in the form of two parallel and spaced apart vertical flanges which project outwardly from the face of the sections 48. The center channel 56 on the bottom rail guide sections 48 located on the outer sides of the door member receive a roller carriage 58 between the vertical flanges thereof which supports the door member for rolling movement along the bottom rail of the rail car. The roller carriage 58 is bolted into the respective center channel 56 so as to permit the roller carriage 58 and the bottom rail guide section 48 upon which it is mounted to be replaced independently of one another.

The bottom rail guide section 48 which is located centrally between the outer two sections of the door member has a cover 60 mounted over the center channel 56 for enclosing the center channel 56 when no roller carriage 58 is supported therein. The cover 60 in the preferred embodiment, includes a hand hold therein for gripping with a person's hand. Other uses of the center channel 56 in the centrally located section 48 include locating a locking mechanism, a door opening and closing mechanism, or control for a sealing mechanism for example, all using threaded fasteners for selective securement to the section 48.

In this arrangement where three bottom rail guide sections 48 are provided, a third roller carriage 58 may optionally be mounted within the center channel 56 of the center section. With the roller carriages 58 being supported on the bottom rail guide sections 48 using threaded fasteners and the bottom rail guide sections 48 similarly being supported on the mounting flanges 30 at the bottom edges of the respective modular sections 16 also using threaded fasteners, any one component of the modular door 10 may be interchanged or replaced independently of the others.

A peripheral guard 62 is mounted on the leading side 64 of the door member. The peripheral guard 62 includes a mounting flange 66 having a similar configuration to the mounting flange 30 along the side edge of the modular sections 16 upon which the guard 62 is to be mounted. The mounting flange 66 similarly includes apertures therein in alignment with the mounting apertures 32 of the modular sections to permit the guard to be bolted to the respective modular sections 16 for independent replacement of the components. A guard flange 70 projects rearwardly from the mounting flange 66 of each section and wraps around a back side of the door member for added structural rigidity at the leading side 64 of the door member.

A peripheral guard 72 is similarly provided on the trailing side 74 of the door member. The peripheral guard 72 includes a mounting flange 78 for selectively bolting the guard 72 to the modular sections 16 of the door member as described above. The peripheral guard 72 includes a guard flange 80 projecting outwardly from the door member parallel to the back sheet of the modular sections 66 of the door for overlapping a periphery of the opening in the rail car at the trailing side of the door.

In use, the modular sections 16 may be replaced one at a time when damaged or can be rearranged by interchanging the position of one modular section 16 for another. The identical configuration of the modular sections 16 permits only a single design to be manufactured and stocked in repair shops while still being able to replace any damaged section of the door member. With the guides 12 and 14 and the guards 62 and 72 having mounting flanges which can be bolted onto the mounting flanges of the modular sections 16, any component of the door 10 can be replaced independently of the other components by simply removing and replacing the threaded fasteners securing the particular component to the door member.

Figure 4:
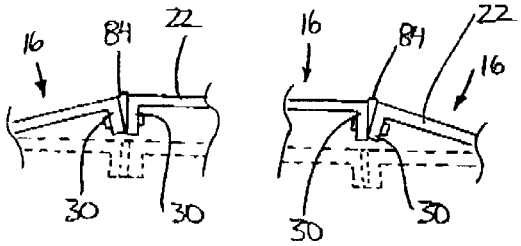
FIG. 4 is a sectional view of panel sections of the door shown in a flexed position in relation to a relaxed position shown in dotted line in that same Figure.

The modular door 10 is further adapted to function as a flexible rail car door by using flexible couplings for securing each of the adjacent modular sections 16 to one another and to the top and bottom rail guides 12 and 14, as well as to the guards at the sides of the door member. The flexible coupling in this instance generally comprises a flat strip 84 or band of resilient material, for example rubber or neoprene and the like, which extends the full length of the mounting flanges 30 on all sides of the modular sections. The band of resilient material can be mounted between any mating pair of mounting flanges, by sandwiching therebetween, to permit some limited relative movement or angular deflection between the respective adjacent sections of the door member as best shown in FIG. 4. The resilient member of the flexible coupling similarly includes mounting apertures therein for receiving the bolts which secure the modular sections 16 of the door together.

The door in this instance is movable between a relaxed position, shown in dotted line in FIG. 4 in which all sections of the door lie in a common vertical plane and a deflected position or flexed position as shown in solid line in that same Figure in which the door is deflected at an intersection between adjacent modular sections of the door in a direction transverse to the plane of the door opening as a result of an impact.

The door member includes at least one lateral intersection extending between respective sides of the door member and dividing the door into panel sections being connected one above the other by the flexible coupling. The door also includes at least one longitudinal intersection extending between respective top and bottom ends of the door member and dividing the door into panel sections being connected laterally adjacent one another by the flexible coupling. Any combination of longitudinal and lateral intersections may be provided.

The flexible arrangement of the rail car door is thus suitably arranged to resist damage due to impacts by permitting the door to be deflected instead of dented. When forming the flexible door out of the modular sections 16, a flexible door can be provided while still taking advantage of all of the benefits of the modular construction of the door 10 permitting any one modular section 16 to be replaced independently of the others.

Figure 5:
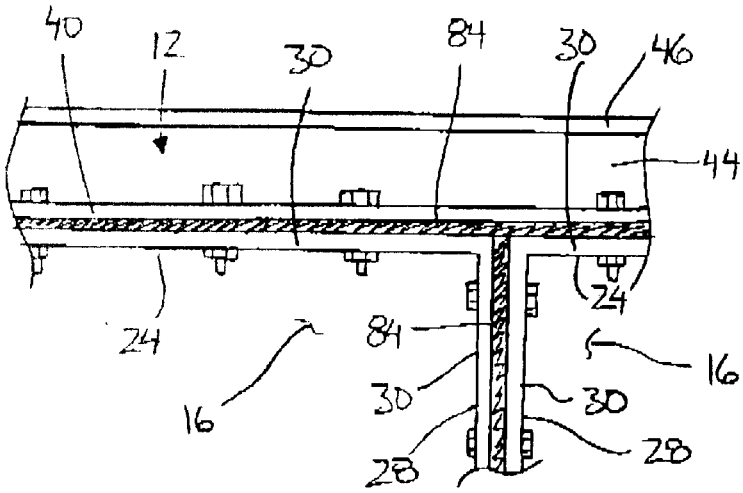
FIG. 5 is a front elevational view of one of the top rail guides supported on a respective panel section.
Figure 6:
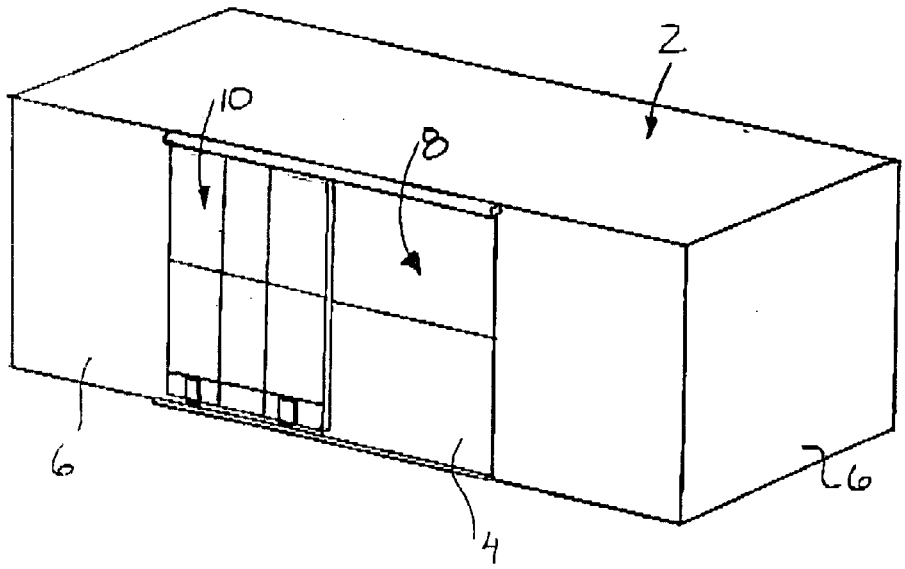
FIG. 6 is an isometric view of a railcar having the door according to FIG. 1 supported thereon.

The guards 62 and 72 at the sides of the door are rigid and continuous, spanning plural panel sections 16, substantially the full height of the door. The guards are coupled to the sections 16 by sandwiching the bands of resilient material therebetween similarly to the mounting between adjacent sections 16 as described above The rigid structures of the guards 62 and 72 as well as the top rail guide, shown in FIG. 5 mounted similarly to the guards, provides structural rigidity to the door while permitting the door panel sections spanning the interior region of the door to remain flexible and movable between respective relaxed and deflected positions.

To further resist denting by fork lift type vehicles and the like, bottom rail guide panel sections 48 are formed of a heavier gage of material than the panel sections 16 of the remaining door member. Additional support plates 82 are mounted along the mounting flanges 30 on the sections 48 which are abutted against adjacent sections 48. The length of the plates 82 are substantially equal to the height of the sections 48 while being formed of thicker gage material so that a powered vehicle may open the door by pushing against the reinforced intersection of the sections 48 upon which the plates 82 are mounted. The plates 82 thus project perpendicularly outward from the sheeted material of the sections 48, a depth which is greater than the depth of the door to provide extra surface for gripping by hand or by machine.

Because denting and damage is typically concentrated in the lower sections of the door, the upper sections may be formed of lighter materials, for example composites including fibreglass and the like. More durable composite materials may be used in any of the panel sections, because the composites are known to be durable and somewhat forgiving to slight impacts as opposed to conventional sheeted steel doors which easily dent.

While one embodiment of the present invention has been described in the foregoing, it is to be understood that other embodiments are possible within the scope of the invention. The invention is to be considered limited solely by the scope of the appended claims.

What is claimed is:

1. A sliding door for a rail car construction comprising a floor, a side wall along one side of the floor and standing upwardly from the floor and an opening in the side wall, the sliding door comprising:

a sliding door member arranged to be mounted on top and bottom rails at the opening extending parallel to a plane of the opening with the door being movable from a closed position at the opening to an open position spaced along the rails from the opening;

the door member including a plurality of panel sections and a flexible coupling connecting at least two of the panel sections together so as to permit deflection of the sliding door member at an intersection of said at least two of the panel sections between a relaxed position and a flexed position in which the intersection is deflected in a direction transversely to the plane of the opening in relation to the relaxed position;

the panel sections being connected at the flexible coupling using threaded fasteners such that the panel sections are selectively separable from one another.

2. The sliding door according to claim 1 wherein the door member includes at least one lateral intersection extending between respective sides of the door member and dividing the door into the panel sections which are connected one above the other by the flexible coupling.

3. The sliding door according to claim 1 wherein the door member includes at least one longitudinal intersection extending between respective top and bottom ends of the door member and dividing the door into panel sections which are connected laterally adjacent one another by the flexible coupling.

4. The sliding door according to claim 1 wherein the intersection between said at least of the two panel sections comprises an end plate on each panel section adjacent the intersection and a resilient material mounted between the end plates.

5. The sliding door according to claim 1 wherein at least two of the panel sections are substantially identical to one another.

6. The sliding door according to claim 1 wherein edges of the panel sections each comprise a mounting flange oriented perpendicularly to a plane of the respective panel section having a plurality of mounting apertures therein, the mounting apertures being arranged for alignment with the mounting apertures of an adjacent panel section when the panel sections are abutted one adjacent the other for receiving respective fasteners therethrough.

7. A sliding door for a rail car construction comprising a floor, a side wall along one side of the floor and standing upwardly from the floor and an opening in the side wall, the sliding door comprising:

a sliding door member arranged to be mounted on top and bottom rails at the opening extending parallel to a plane of the opening with the door being movable from a closed position at the opening to an open position spaced along the rails from the opening, the door member including:

a plurality of panel sections and a flexible coupling connecting at least two of the panel sections together so as to permit deflection of the sliding door member at an intersection of said at least two of the panel sections between a relaxed position and a flexed position in which the intersection is deflected in a direction transversely to the plane of the opening in relation to the relaxed position; and a peripheral guard supported on each side of the door member, the peripheral guard spanning a plurality of the panel sections along respective sides of the door member.

8. The sliding door according to claim 7 wherein the door is divided horizontally into a plurality of the panel sections, each peripheral guard comprises a rigid member spanning substantially a full length of the respective side of the door member.

9. A sliding door for a rail car construction comprising a floor, a side wall along one side of the floor and standing upwardly from the floor and an opening in the side wall, the sliding door comprising:

a door member arranged to be supported on top and bottom rails at the opening extending parallel to a plane of the opening, movable from a closed position at the opening to an open position spaced along the rails from the opening;

the door member comprising a plurality of panel sections, each panel section having top, bottom and side edges selectively mounted to corresponding edges of respective adjacent panel sections each having a similar configuration such that the panel sections are selectively separable from one another; and top and bottom rail guides arranged to be selectively mounted on the respective top and bottom ends of the sliding door member, the top and bottom rail guides being arranged to support the door member on the respective top and bottom rails;

at least some of the panel sections being identical to one another whereby the selective mounting of the panel sections permits the panel sections to be interchangeable.

10. The sliding door according to claim 9 wherein the panel sections are all identical to one another.

11. The sliding door according to claim 9 wherein top edges of the respective panel sections are all substantially identical to one another and wherein bottom edges of the respective panel sections are all substantially identical to one another.

12. The sliding door according to claim 9 wherein side edges of the panel sections are all substantially identical to one another.

13. The sliding door according to claim 9 wherein all edges of the panel sections are similar in configuration to one another.

14. The sliding door according to claim 9 wherein the top rail guides are supported on the top edges of respective panel sections at the top end of the door member by threaded fasteners.

15. The sliding door according to claim 9 wherein the bottom rail guides are supported on the bottom edges of respective panel sections at the bottom end of the door member by threaded fasteners.

16. The sliding door according to claim 9 wherein the panel sections include a plurality of side panel sections mounted along respective sides of the door member and a plurality of intermediate panel sections mounted between the respective side panel sections, the side panel sections all being identical to one another.

17. The sliding door according to claim 9 wherein there is provided a peripheral guard supported on each side of the door member, the peripheral guard being arranged to be supported on the respective side edges of the panel sections along the respective sides of the door member using threaded fasteners.

18. A sliding door for a rail car construction comprising a floor, a side wall along one side of the floor and standing upwardly from the floor and an opening in the side wall, the sliding door comprising:

a door member arranged to be supported on top and bottom rails at the opening extending parallel to a plane of the opening, movable from a closed position at the opening to an open position spaced along the rails from the opening;

the door member comprising a plurality of panel sections, each panel section having top, bottom and side edges selectively mounted to corresponding edges of respective adjacent panel sections each having a similar configuration;

top and bottom rail guides arranged to be selectively mounted on the respective to and bottom ends of the sliding door member, the to and bottom rail guides being arranged to support the door member on the respective top and bottom rails; and a base section selectively mounted on the bottom edge of each panel section adjacent the bottom end of the door member, the bottom rail guides being supported on the base sections;

whereby the selective mounting of the base sections permits the base sections to be selectively separable for replacement thereof.

* * * * *